United States Patent [19]

Micheletti

[11] 4,120,179

[45] Oct. 17, 1978

[54] YARN CUTTING DEVICE FOR A CIRCULAR KNITTING MACHINE

[75] Inventor: Fabrizio Micheletti, Fucecchio Italy

[73] Assignee: Brematex S.p.A., Prato, Italy

[21] Appl. No.: 817,345

[22] Filed: Jul. 20, 1977

[30] Foreign Application Priority Data

Jul. 20, 1976 [IT] Italy ..... 9532 A/76

[51] Int. Cl.[2] ..... D04B 15/61

[52] U.S. Cl. ..... 66/145 R; 66/140 R

[58] Field of Search ..... 66/145 R, 140 R, 134, 66/142

[56] References Cited

U.S. PATENT DOCUMENTS

| | | | |
|---|---|---|---|
| 1,945,971 | 2/1934 | Gagne | 66/145 R |
| 3,648,485 | 3/1972 | Boy et al. | 66/145 R |
| 3,739,602 | 6/1973 | Haas | 66/145 R |

*Primary Examiner*—Werner H. Schroeder
*Assistant Examiner*—Andrew M. Falik
*Attorney, Agent, or Firm*—Richards, Shefte & Pinckney

[57] ABSTRACT

A circular knitting machine having a program or pattern drum coaxial and underlying the needle cylinder. The pattern drum is advanced intermittently and selectively by pawls engaging ratchet wheels of different pitch on the drum, with the pawls driven with different strokes through shafts parallel with the cylinder axis and oscillated by followers riding on cams on the needle cylinder, the followers being selectively and independently displaceable by electro-mechanical units to produce intermittent operation of the pattern drum. Cams on the drum act through followers mounted on shafts coaxial with the cylinder axis to oscillate operating arms for controlling radial cams for needle and jack butt manipulation, for controlling an arm with an inclined surface for displacing the cylinder to adjust the length of the loop being knit, and for controlling other instrumentalities of the machine. A yarn cutting device is mounted above the cylinder for free rotation and for lowering for driven engagement of an annular resilient friction member on the underside of the device by the cylinder through the knit fabric, thereby rotating the device to effect cutting of the knitting yarn.

6 Claims, 32 Drawing Figures

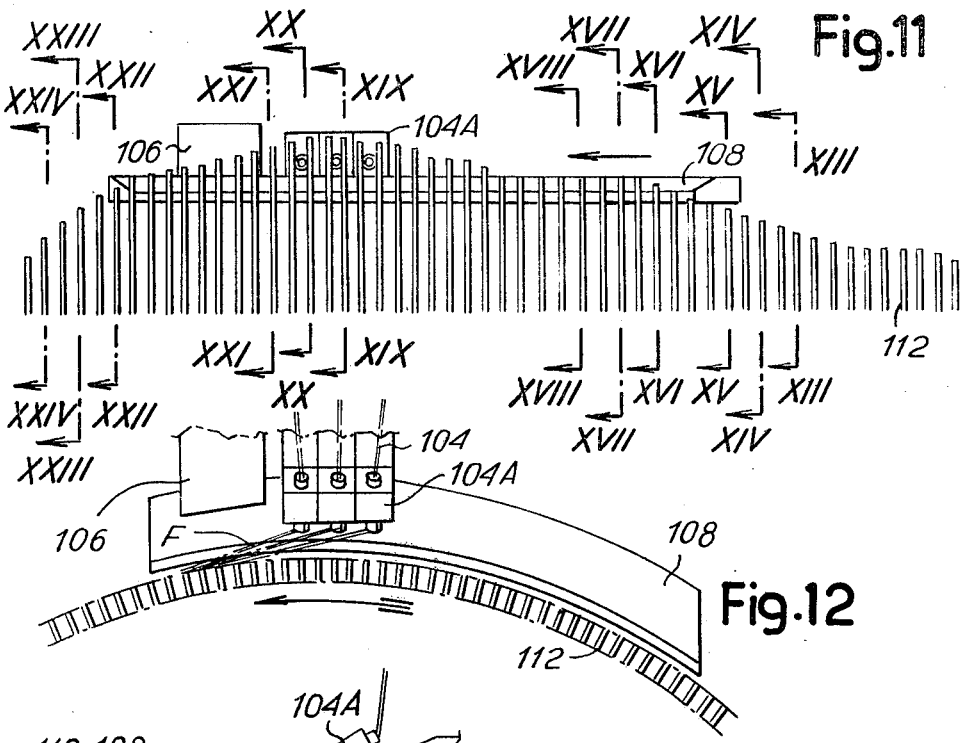
Fig.11
Fig.12
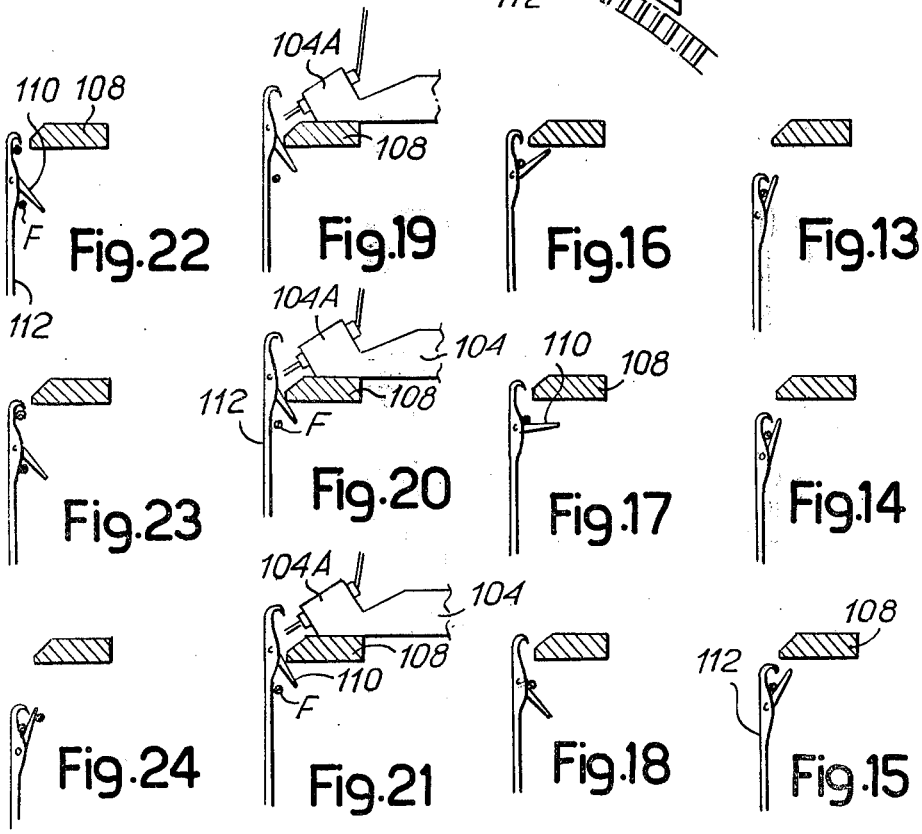

Fig. 26
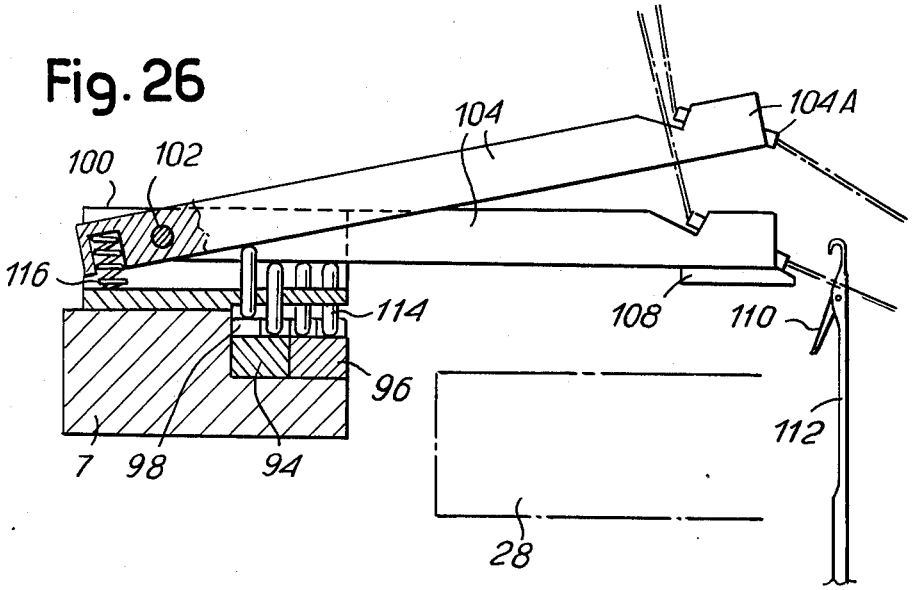
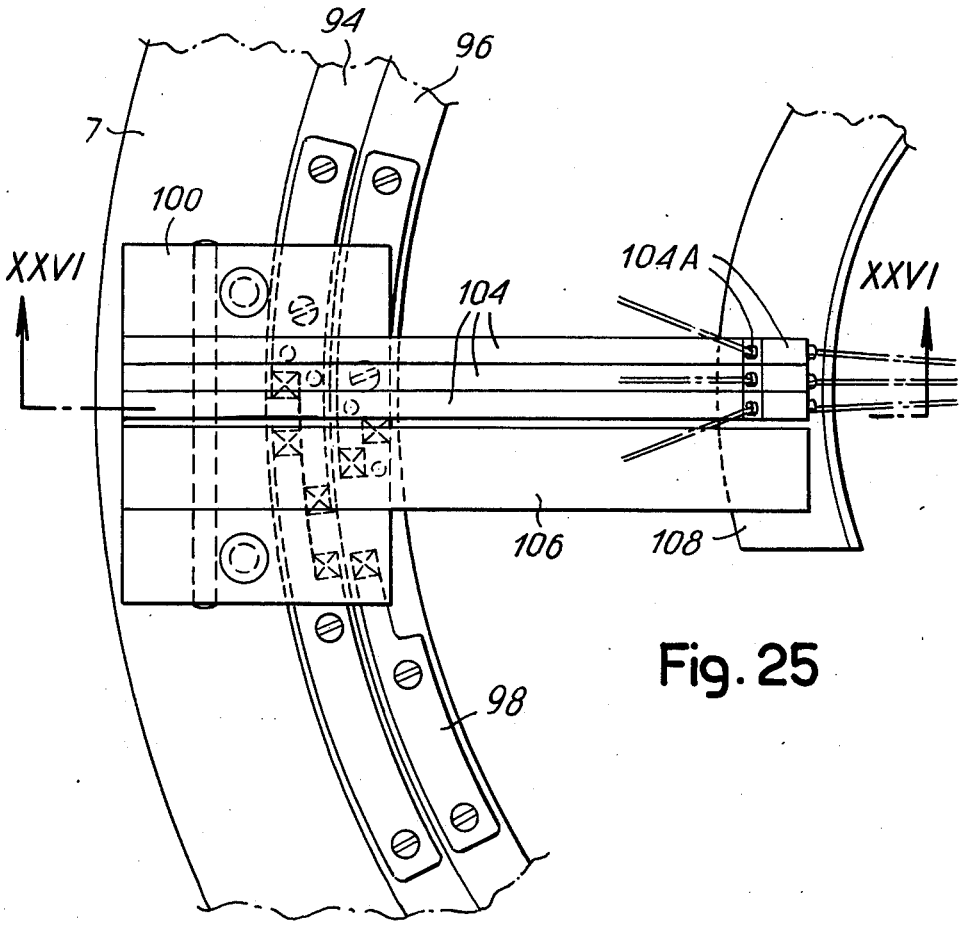
Fig. 25

YARN CUTTING DEVICE FOR A CIRCULAR KNITTING MACHINE

BACKGROUND OF THE INVENTION

The present invention relates to yarn cutters for circular knitting machines, and more particularly to yarn cutters of the type having a toothed disc that is rotatable at the knitting end of a needle cylinder to engage yarn and cooperating with a stationary cutter blade to effect cutting of the yarn.

Conventional yarn cutters of the rotating disc type are normally used in circular knitting machines that have a drive mechanism for rotating components of the machine in addition to the needle cylinder and which mechanism is utilized for positively rotating the disc of the cutter independent of though synchronously with the needle cylinder. These are relatively complicated and expensive machines and require linkages to connect the drive to the disc. In simple less complicated machines no rotating disc type cutter has been utilized because of the absence of a rotary drive and the expense and complication of providing such a drive.

However, the present invention provides a rotary disc yarn cutting mechanism that does not require a rotary drive and can be utilized on simple machines that have no such drives without requiring provision of a drive. This is uniquely accomplished in the present invention by rotating the disc by direct engagement with the upper end of the needle cylinder and simply moving the disc from a non-rotating inoperative position into needle cylinder engagement for a yarn cutting operation.

SUMMARY OF THE INVENTION

Briefly described, the yarn cutting device of the present invention is incorporated in a circular knitting machine of the rotating cylinder type having a ring mounted at its upper end over which the fabric being knit passes into the cylinder. The device includes a support on which is mounted a disc for free rotation coaxial with the cylinder and movable into frictional engagement with the ring of the cylinder with the fabric being knit therebetween. This cylinder engagement results in rotation of the disc with the cylinder. The disc is provided with peripheral teeth for yarn engagement and stationary cutting means are mounted on the support in cooperation with the rotating disc to cut yarn. Means are provided for moving the disc into ring engagement for yarn cutting rotation therewith and away from the ring to an inoperative position.

Preferably, an annular resilient friction element is seated in the device facing the cylinder ring for engagement therewith to enhance transmission of rotation of the cylinder to the disc.

In the preferred embodiment, the device includes a column slidably mounted in the support with a plate mounted for free rotation on the column and carrying the disc, with the moving means sliding the column to move the disc between yarn cutting and inoperative positions. The aforementioned annual friction element is seated in the plate facing the cylinder ring. An operating lever is engagable in a notch in the column to retain the disc in either the yarn cutting or inoperative positions, with the moving means acting through the lever to move the column, the lever being disengagable from the notch to permit movement of the column away from the cylinder to permit access thereto. Resilient means are provided for urging the column away from the cylinder to move the column away from the cylinder when the lever is disengaged from the notch and to urge the column to position the disc in its inoperative position when the lever is engaged in the notch, and the moving means acts through the lever and against the urging of the resilient means to move the disc to its yarn cutting position.

BRIEF DESCRIPTION OF THE DRAWINGS

FIG. 11 is an elevational development view of the needles, latch guide and yarn feed fingers as viewed facing one set of feed fingers of the machine of FIG. 1;

FIG. 12 is a plan view of the elements of FIG. 11;

FIGS. 13–24 are vertical section views taken along lines XIII—XIII through XXIV—XXIV of FIG. 11;

FIG. 25 is an enlarged plan view of one set of yarn feed fingers and associated instrumentalities of the machine of FIG. 1;

FIG. 26 is a vertical sectional view taken along line XXVI—XXVI of FIG. 25;

DETAILED DESCRIPTION OF THE PREFERRED EMBODIMENT

Figure 1:
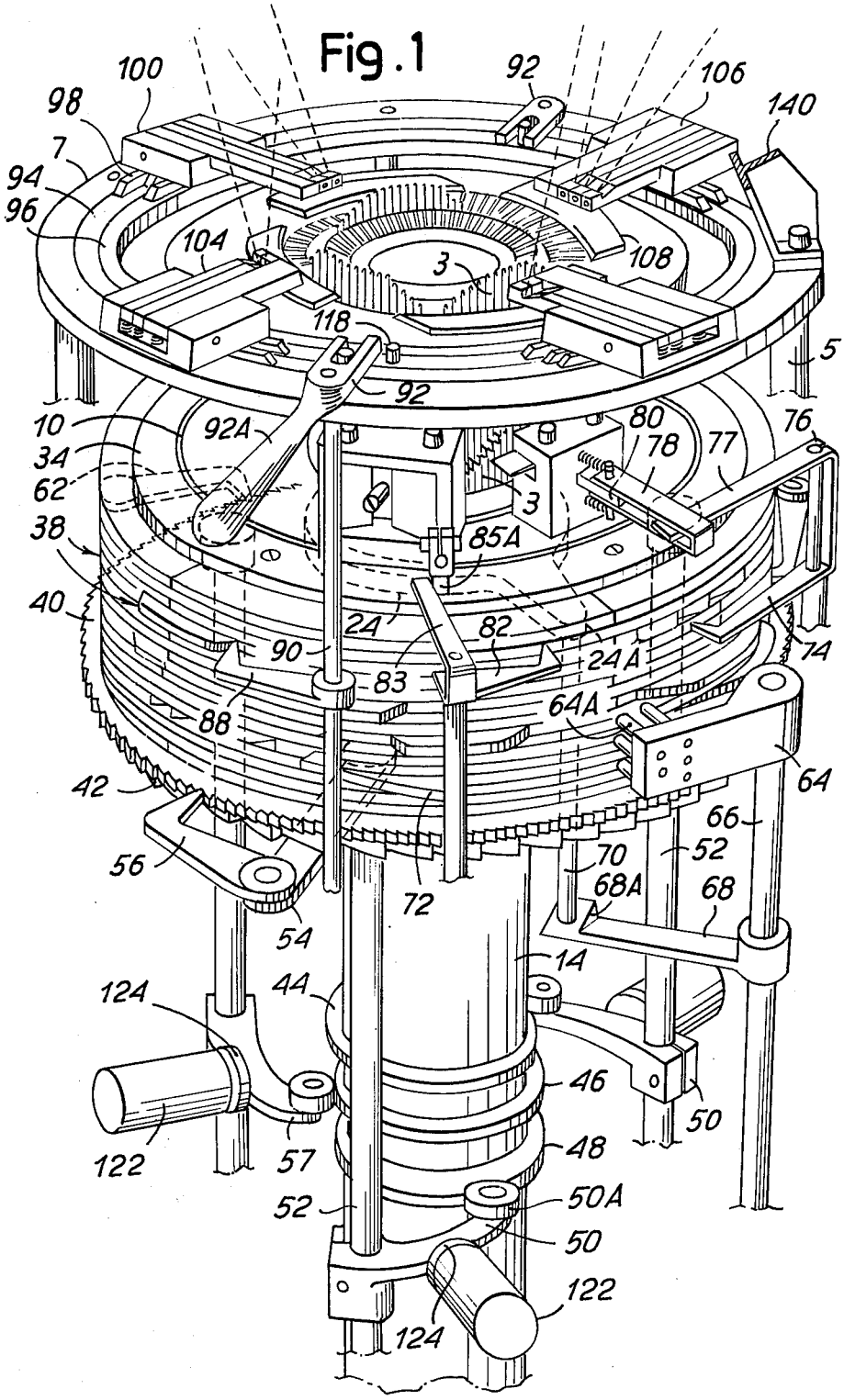
FIG. 1 is a perspective view of the pertinent portions of a knitting machine incorporating the preferred embodiment of the present invention.
Figure 2:
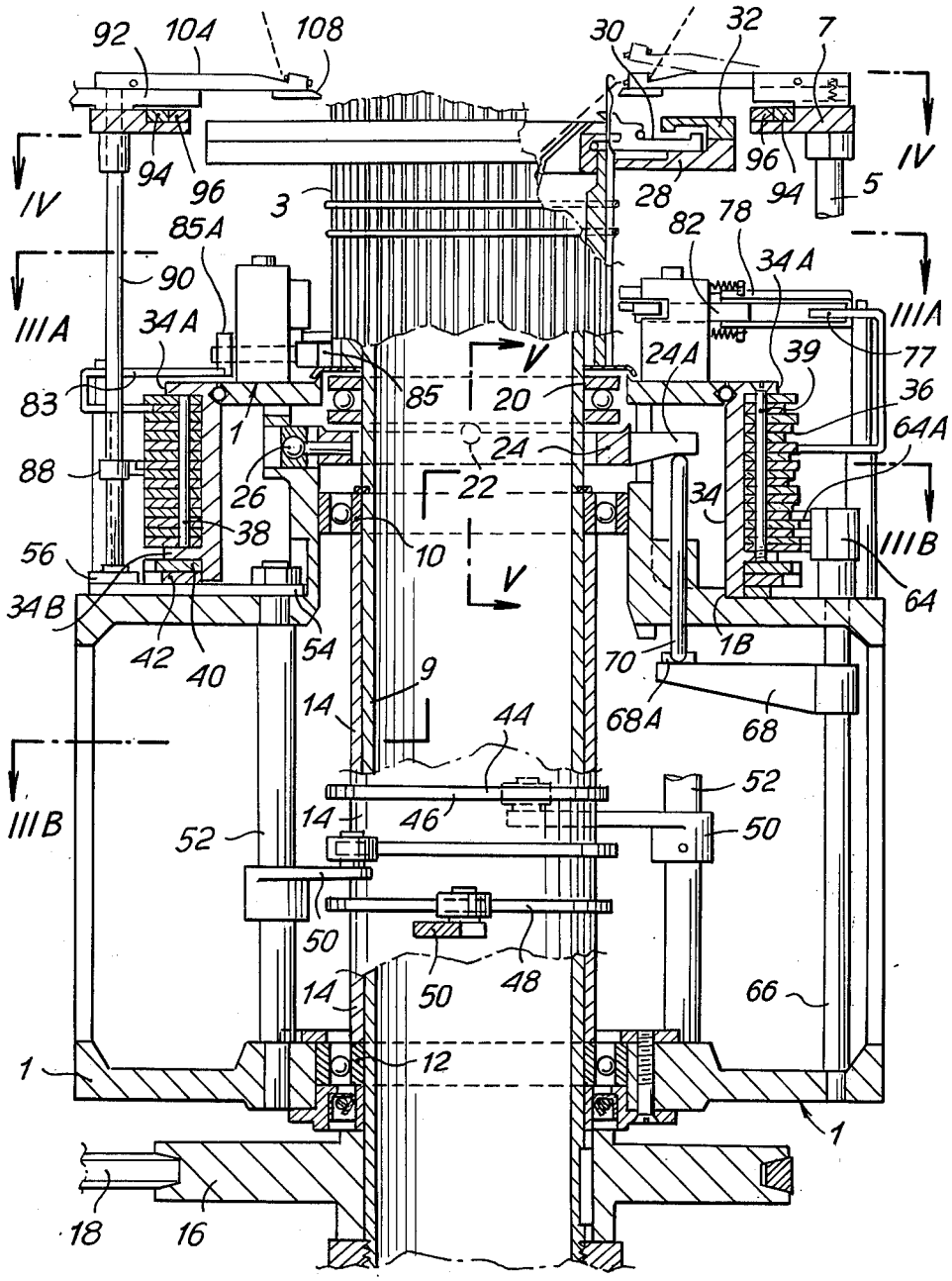
FIG. 2 is an elevation view, partially in section, of the portion of the knitting machine shown in FIG. 1.
Figure 3A:
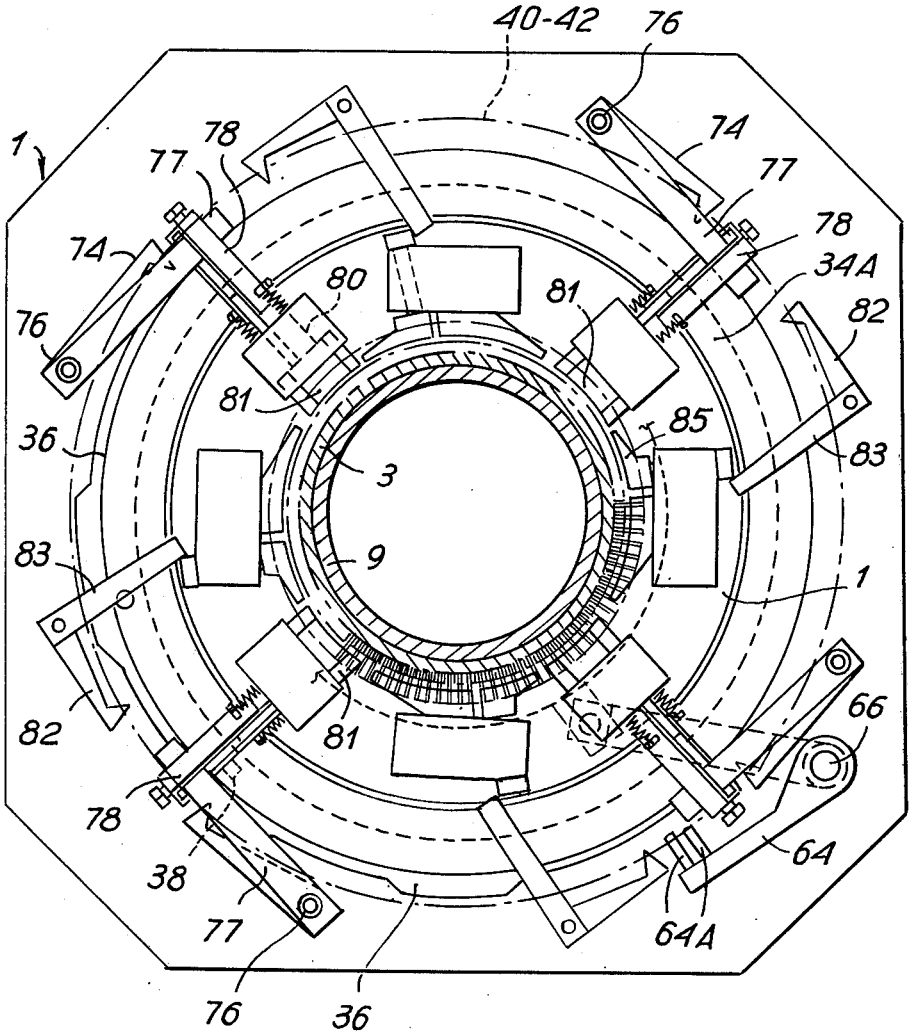
FIGS. 3A, 3B and 4 are horizontal section views taken along lines IIIA—IIIA, IIIB—IIIB and IV—IV of FIG. 2.
Figure 3B:
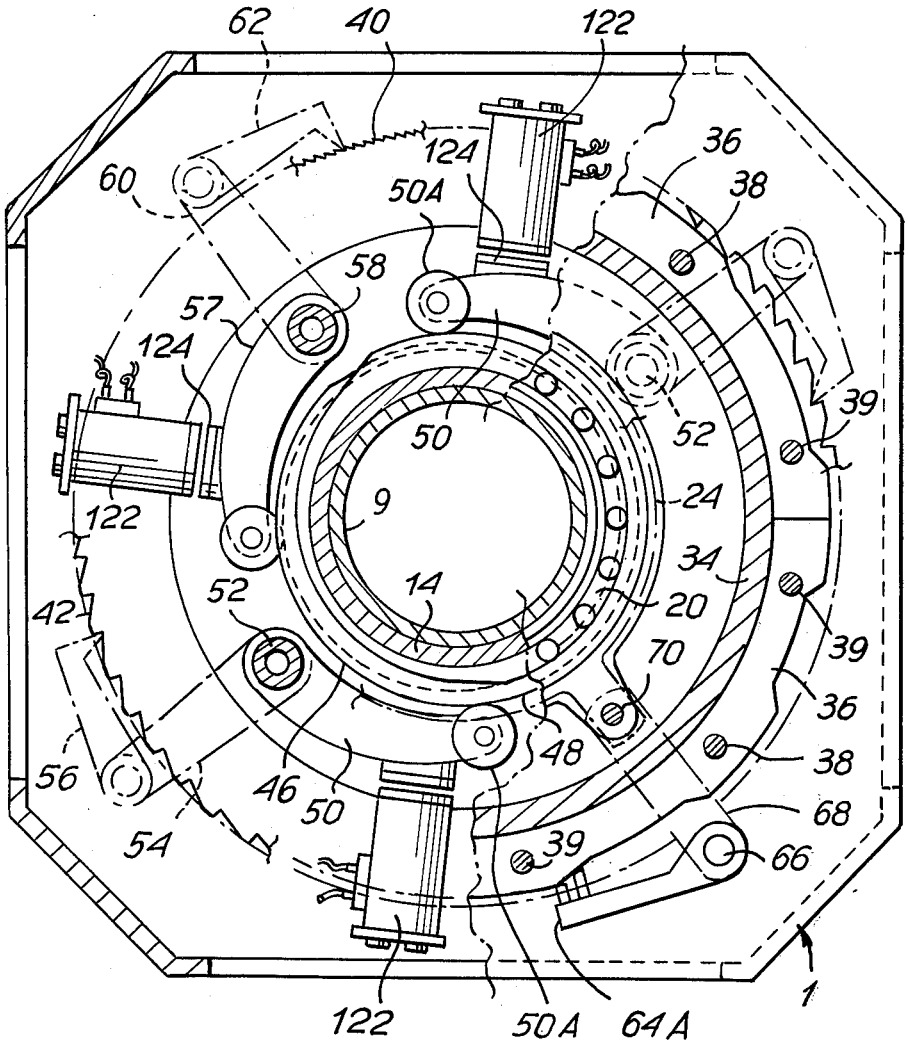
Figure 5:
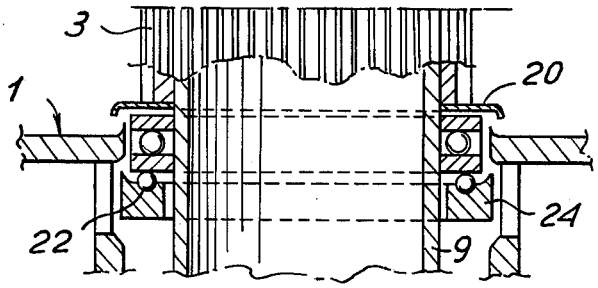
FIG. 5 is a vertical section taken along line V—V of FIG. 2.
Figure 6:
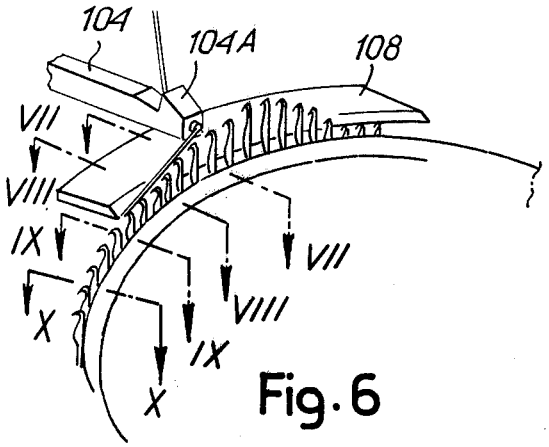
FIG. 6 is an enlarged perspective view of a series of needles, a latch guide plate and the end of a feed finger that feeds yarn to the needles.
Figure 7:
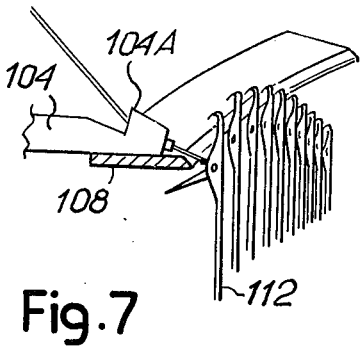
FIGS. 7, 8, 9 and 10 are perspective section views taken along lines VII—VII, VIII—VIII, IX—IX and X—X, respectively of FIG. 6.
Figure 8:
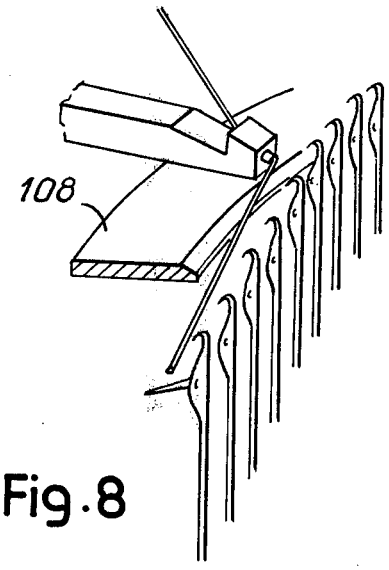
Figure 9:
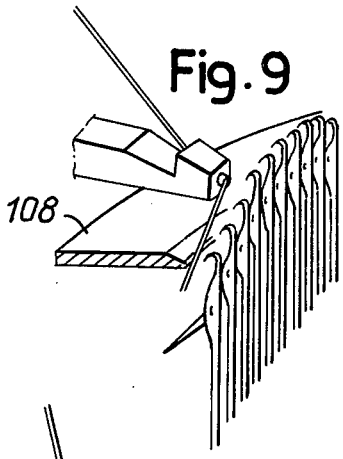
Figure 10:
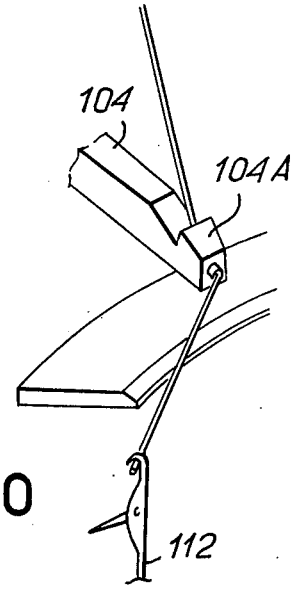

In the accompanying drawings, 1 generically denotes a main supporting frame or mounting for a needle cylinder 3. In FIG. 1 this frame 1 is mostly omitted for clearness's sake. An annular element 7 is supported onto the frame by means of columns 5, with the annular element surrounding the needle cylinder upper end area. The needle cylinder 3 is slidably assembled but rotatably coupled to a tubular shaft 9 which is mounted on the frame 1 by means of radial bearings 10 and 12 that are mounted on the shaft 9 with annular spacers 14 intermediate the shaft and bearings. The shaft 9 and supported cylinder 3 are rotatably driven through a pulley 16 mounted on the shaft 9 and around which is trained a drive belt 18. The cylinder 3 by means of an axial bearing 20 bears on small diametrically opposed balls 22 borne by a ring 24 (also see FIG. 5) that is pivoted at 26 to the frame 1 peripherally intermediate the small balls 22 and has at its end opposite to the pivot 26 an operative extension 24A actuated in a hereinafter described manner to vary the axial position of the cylinder and thereby the length of the loop of yarn being knit. At the upper end of the needle cylinder 3 a sinker ring 28 is mounted for control of sinkers 30, according to a conventional arrangement, and sinker operating cam means are provided on a smaller ring 32, mounted on the sinker ring 28 in a position angularly fixed and axially movable with the cylinder 3.

A program or pattern drum 34 is mounted on the frame 1 coaxial with and underlying the needle cylinder by means of a step 1B and a circular wall 10. The drum 34 is slowly rotatable independent of the cylinder 3 and in the hereinafter indicated manner for operating a jack control system and other instrumentalities. The drum 34 has a wide outer groove or race defined by flanges 34A, 34B and designed to accommodate a plurality of radial cams in the form of superimposed plates stacked within the groove between the flanges 34A and 34B. In particular, provisions may be made for packs of cams 36 developed according to annular sectors, and engaged to one another, for instance, by a stem 38 which engages them temporarily one to the other to aid the assembly of the sector cam packs 36 within the annular groove or race of the drum 34. The cams pack 36 is locked by means of a pair of screws 39 which pass through the upper flange 34A and are screwed to the lower flange 34B, thus locking the sector cam pack 36. Through this arrangement, the cam can be easily mounted and disassembled with respect to the drum 34 carrying them, by presenting the drum in a given accessible position, by removing the screws 39 and taking away the sector cam pack 36, and by introducing a new pack of sector cam pack 36, and by introducing a new pack of sector cams according to the desired arrangement, and reassemblying the screws 39 to lock the cam pack to the drum 34. In the groove between the flanges 34A and 34B a plurality of cams can be mounted which are aligned sector by sector to define annular tracks of radial cams for hereinafter indicated controls.

The pattern drum 34 is actuated with a slow rotation by a ratchet mechanism driven by the needle cylinder motion to control the working knitting cycle with the advancement or stop of the drum 34 controlled according to a program which supplies electric stoppage and start signals.

For the advancement of the drum 34, it has mounted thereon two ratchet wheels 40 and 42 having inclined teeth, the wheel 40 having much closer teeth than those on the wheel 42. The machine program provides for the rotation by a full revolution of the drum 34 with the cams 36, at each production of an article. Three cams 44, 46, 48 are coupled in a rotary manner to and positioned on the tubular shaft 9 by spacers 14. Each of the cams 44 and 48 act on the roller 50A of a follower 50, which is assembled on a shaft 52 parallel to the axis of the needle cylinder. At the upper end, each of the two shafts 52 carries an arm 54, a pawl 56 being linked to the outer end thereof and being stressed resiliently against the lower ratchet wheel 42 having more spaced teeth. The two pawls 56 and the associated actuation cams are in such mutual relationship that at each half-revolution of the needle cylinder two successive advance movements are imparted to the ratchet wheel and thus to the drum, to obtain an averagely uniform motion. A similar arrangement with a follower 57 cooperates with the cam 46 to determine the actuation of a shaft 58 similar to the one 52 for an arm 60 actuating a pawl 62 designed to act on the ratchet wheel 70 having closer teeth. This arrangement of pawls imparts very slow angular movements to the drum 34 for the control of the follower 57.

The movements of the pattern drum caused by the pawls 50, 56 serve to obtain movements of the instrumentalities associated with the needle cylinder 3. The slow movement obtained with the pawls 57, 62 serves to vary the axial position of the needle cylinder and thus to vary the length of the loops being knit. Since the variation of the loop length must be very slow, recourse is had to the pawl acting on the ratchet wheel 40 having very close saw-teeth. In order to determine this axial movement of the needle cylinder for the above-indicated purpose, the cams which are the lowest in the pack or pile as shown in the drawing are used. These cams cooperate with pin followers 64A carried by an arm 64 integral to a shaft 66, which is assembled on the frame 1 parallel to the axis of the needle cylinder. The pins 64A of the arm 64 are located on different levels to cooperate with successive superimposed cams in the several positions during a cycle of the pattern drum 34.

The shaft 66 has an arm 68, which is provided at its end with an inclined plane profile 58A which can act on a follower 70, slidably assembled on the frame 1 parallel to the axis of the needle cylinder 3, to act on the end 24A of the above-described ring 24. Small angular movements of the unit 64, 66, 68 determine a slight axial movement of the follower 70 and thus a raising and a lowering of the ring 24 about its pivot 26; this determines an axial movement of the needle cylinder through the ball bearings 22. FIG. 1 shows a cam 72 of the drum 34 which has a very gradual profile and acts thereby in a very gradual manner on the unit 64A, 64, 66, 68, 70 to determine the slow movement of the needle cylinder in the axial direction, and thereby the slow variation of the length of loops being knit. The profile of the cams acting on the follower 64A can cause increasing and decreasing changes in the length of loops.

The other cams of the cam pack 36 assembled on the drum 34 serve to carry out the several controls of the cams acting on the needle and jack butts of the needle cylinder, as well as to effect picking and releasing of yarns and all the other movements which are typical of a conventional knitting operation.

For the control of the radially movable cams and their action on the jack and needle butts, there are provided followers 42, one for each of the cams formed by the drum 34, each follower 74 being assembled on a shaft 76 parallel to the axis of the needle cylinder and assembled movably on the frame 1. Each shaft 76 carries, in a suitable position above the level of the bearing 20, an arm 77 designed to act through an appropriate member 78 on the slide 80, which is mounted for radial sliding, to control the exclusion of the cam 81 of the cam shell arranged around the cylinder 3, against the counteraction of springs which tend to insert it. The different heights of the cams 36 enable the extraction, the partial insertion, the total insertion or the insertion at different levels of cams such as those 84 or the like. Other cams of the drum act on followers 82 integral to arms 83, which arms 83 act on radial extensions 85A of angularly movable cams 85. Arrangements of this type are arranged at different positions around the circumference of the needle cylinder to effect the controls of the cams in the different positions in which they are located in the needle cylinder.

Figure 4:
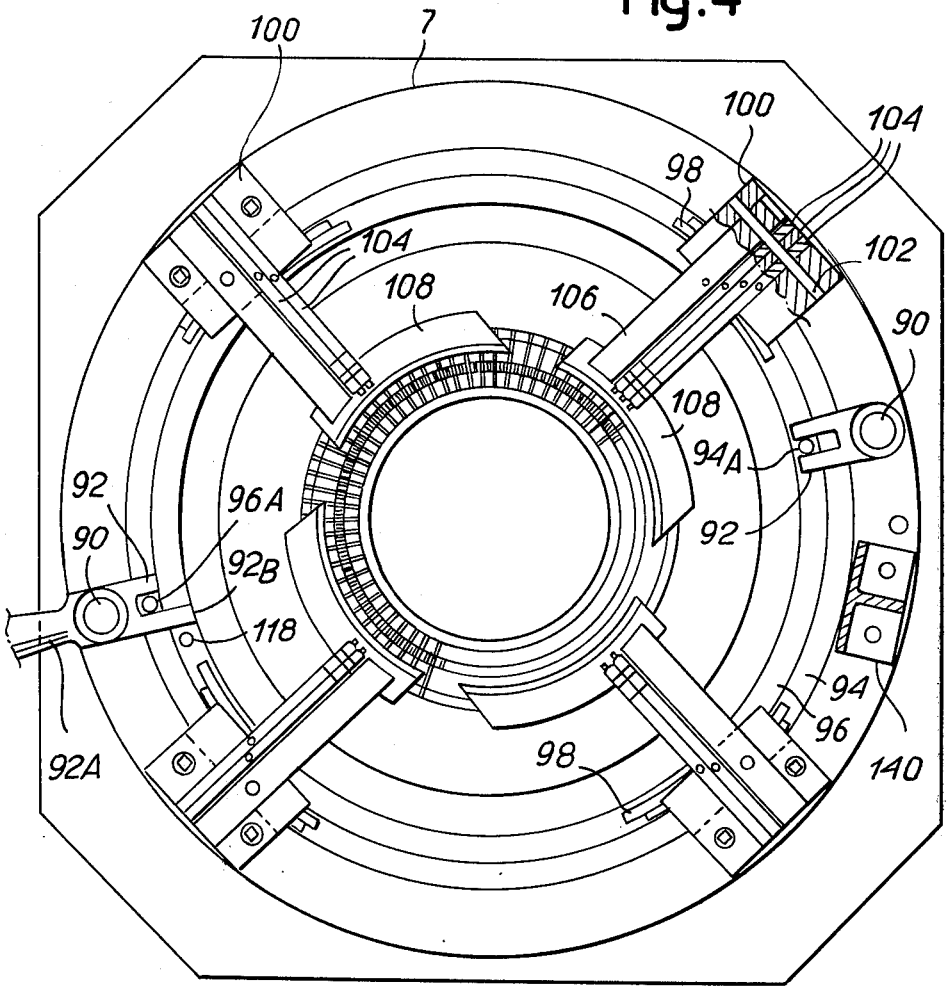

Arrangements similar to those described serve to operate yarn guides, wherein followers 88 similar to the followers 74 are mounted on shafts 90 similar to the shafts 76 and extending to the annular element 7 to operate forks 92 for the hereinafter indicated purposes. According to the example, there are provided two forks 92 substantially diametrically opposite. A housing is formed on the annular element 7 for two rings 94 and 96 mounted one within the other and angularly movable around their center which is located on the axis of the needle cylinder, the movement of the rings being determined by the control operated by the two forks 92. One of these forks engages a pin 96A of the outer ring 96 and the other one of the forks engages a pin 94A of the other one of the rings 94. On each of the two rings 94 and 96, there are provided at each of four yarn feeds corresponding cam profiles generically denoted by 98. There are four yarn feeds around the needle cylinder in the embodiment shown. In correspondence of each feed there is provided on the ring 7 a support 100, on which a plurality of lever members are articulated at 102 advantageously in a coaxial manner, with the members extending toward the cylinder 3. Some of the levers 104 form yarn guides 104A, while at least one of them for each feed, indicated by 106, serves to carry a plate 108 for guiding and protecting the latches 110 of the needles 112 of the needle cylinder 3. In order to act on the levers 104 and 106 there are provided follower pins 114 guided on the support 100 and raisable by means of the profiles 98, to lift the levers 104 and 106 against the counteraction of springs 116 acting on the outer ends of the same levers. The springs 116 stress each of the levers 104 and 106 into active position and therewith the yarn guides 104A and the guide plates 108, the active position being defined by the corresponding feed bearing either on the pins 114 or on the support 100 of the corresponding feed. Through the control by the shafts 90 and the forks 92 there is an independent positioning of the two rings 94 and 96 and thereby the desired selection of the yarn guides as a function of the position of the raising and lowering profiles 98. One of the two forks 92 has a lever 92A for hand operation for the control of the outer ring 96, and also has one of its two arms 92B (see FIG. 4) longer than the other to be able to operate both rings 94 and 96, owing to the presence of a pin 118 on the ring 94 in such a manner as to determine manually the simultaneous movement of both rings 94 and 96. This simultaneous control serves to operate a full raising of all the levers 104 and 106 and of the guide plates 108, when it is necessary to gain access to the upper section of the needle cylinder, as often required in the use of the machine.

Through the control systems of the cams 38 of the drum 34, control is obtained for the shell cams—such as the cams 81 and 85—acting on the needle and jack butts, and of the yarn guides as well as the exclusion of all the yarn guides and the plates 108 from the needle working zone, at the upper end of the cylinder. Control is also obtained, with the cams 72 acting on the followers 74A, of the variation of the loop length during certain working stages of the operation of the machine.

An appropriate program may be used to determine the advance stages of the pattern drum 34 and thereby the stages in which occurs a switching both in the shell cams, in the yarn guides and in the axial position of the cylinder for the variation of the length of loops. In order to obtain the variation of the loops with a high graduality, though keeping the angular space required for this operation within a limited extent, there is provided the small-pitch advance system with the ratchet wheel 40 having very close teeth. For the switching of the cams for the action on the yarn guides and on the shell cams, provision is made, on the contrary, for wider movements with the ratchet wheel 42. In any case, the jack advance movement operated for each revolution of the needle cylinder is selectively obtained for some of the program stages during the operating cycle, while for other stages of the cycle the drum 34 is kept stationary, as no switching is required.

In order to exclude the drum 34 from the advance movement, the followers 50 and 57 are lifted from their respective cams 44, 48 and 46, so as to interrupt the reciprocating angular movements of the followers and thus the advance of the drum. For this purpose, electromagnetically operated devices are designed which are, for all the followers 50 and 57, indicated at 122. These devices include electromagnets and permanent magnets designed to act on respective keepers 124 which approach to the pole shoes of the magnets 122 during the radial movement towards the outside of the respective followers and which are left free or retained according to the energization conditions of the electromagnetic devices. For a safe operation (in the event of a power failure), the electromagnetic devices operate to retain the respective followers and thus the respective keepers 124 by action of a permanent magnet, whose action is neutralized by the energization of a winding, which in this way — when energized — allows the operation of the follower while in absence of power, the follower 50 is attracted and thus the interruption of the oscillation is determined.

A suitable program allows to effect the actuation of the several quick-pitch or slow-pitch advance systems according to the requirements of the working cycle of an article. In this way, the periphery of the drum 34 is sufficient to obtain working programs for a working cycle. The program which acts on the electromagnets may be of the electric type (punched tape or the like) or of the mechanical type, for instance of the chain-type.

FIGS. 6 to 24 show the operation of the needle latch guide plate 108 and the way of feeding the yarn F to the needles at any feed, so as to show how this yarn is fed without contacting any member of the respective feed, but being directly supplied to the needle which is to pick it up. In these figures, where the arrows indicate the relative movement of the needles with respect to the plate 108 and the yarn guides 104A, it is noted that during the raising of the needles 112 to reach a yarn guide 104A, a latch-opener 126 acts on the latches of the needles being raised to maintain them open. This results in the latch being open and below the plate 108, when the needle reaches the edge thereof.

The presence of the inner edge of the plate 108 prevents the latch 110 from accidentally being raised again and closing the end hook of the needle which is to pick the yarn up. The position of the yarn guide 104A with respect to the plate 108 and to the trajectory of the needles is such (see FIGS. 7 to 10 and 12 to 24), that the guide in practice does not touch either the inner edge of the plate 108 or any other element connected to the respective yarn feed, arriving directly at the needle which is to pick it up and form the loop by its lowering. This avoids on one hand undesirable yarn damage and on the other hand the wear of the members which might contact the yarn. The same inner edge of the plate 108 is not particularly subjected to wear-stress, as the possible contact of the needle latch is accidental, not systematic. This results in a positive operation of the yarn feeds and a substantial simplicity of the different members connected with each of the yarn feeds, while any breakdown of the latches is avoided.

When replacing the yarns by means of the operation of the yarn guides 104, 104A to insert or remove yarns, it is necessary to cut the yarns, which is usually effected — according to conventional arrangements — by means of a disc-saw yarn cutter formed by a disc-like or annular element having a saw-tooth gear designed to engage the yarn to be cut and to carry it towards a cutting knife, or towards one or the other of a plurality of cutting knives provided around the circumference of the toothed disc, the latter being located in the interior of the annular path of the upper end of the needles. The annular saw, that is circular saw, must rotate substantially at the speed of the needle cylinder, so as to effect a satisfactory cutting as to the length of the yarn residual piece coming out of the knitted fabric. Usually these saws are mounted on a disc, which in a simple machine as the one now being described is not provided, as there is no requirement for the operation conventionally entrusted to this disc. Thus, in replacement of the disc there is provided a device, particularly shown in FIGS. 27 to 31, which serves to cut the yarns and is caused to intervene at the moment when the yarn is to be cut.

This cutting device includes a supporting arm 140 projecting from the fixed annular element 7 borne by the frame 1, and extending to the area of the extension of the needle cylinder axis. In an end head 140A of the support 140 there is provided a housing coaxial to the needle cylinder axis for a column 142 which can slide with respect to the head 140A and is fixed against rotation. The column 142 is urged upward by a spring 144 which by pressing on the head 140A pushes upwardly a plate 146 integral to the upper end of the column 142. At the lower end of the column 142 there is an expanded head 142A, below which there is provided an upper plate 148 and a lower plate 150 both borne by a shaft 142 internal and coaxial to the column 142 and assembled for rotation therein. The column 142 is prevented from rotating by a groove 142B, in which coacts a dowel 154 borne by the head 140A. A disc 156 is mounted between the peripheries of the plates 148, 150 and projects outwardly therefrom with teeth formed around its periphery. The disc 156 is designed to cooperate with one or more of the conventional stationary cutting blades 158 carried by arms 160 integral to the head 142A. The lower plate 150 has a flared underneath profile which substantially corresponds to a frustum-cone portion of the inner profile of a ring 3B assembled in the interior of the upper end of the needle cylinder along which the fabric being formed is produced. The profile of the plate 150 has an annular groove or race for an annular resilient friction element 162 of rubber or the like, which can bear, upon lowering of the plate 150, on the inner frustum-cone surface of the ring 3B of the needle cylinder 3 with the fabric M under formation being inbetween (in particular see FIG. 27). On the upper plate 148 there is provided protecting piece 148A which rotates with the unit 148, 150, 152.

Figure 27:
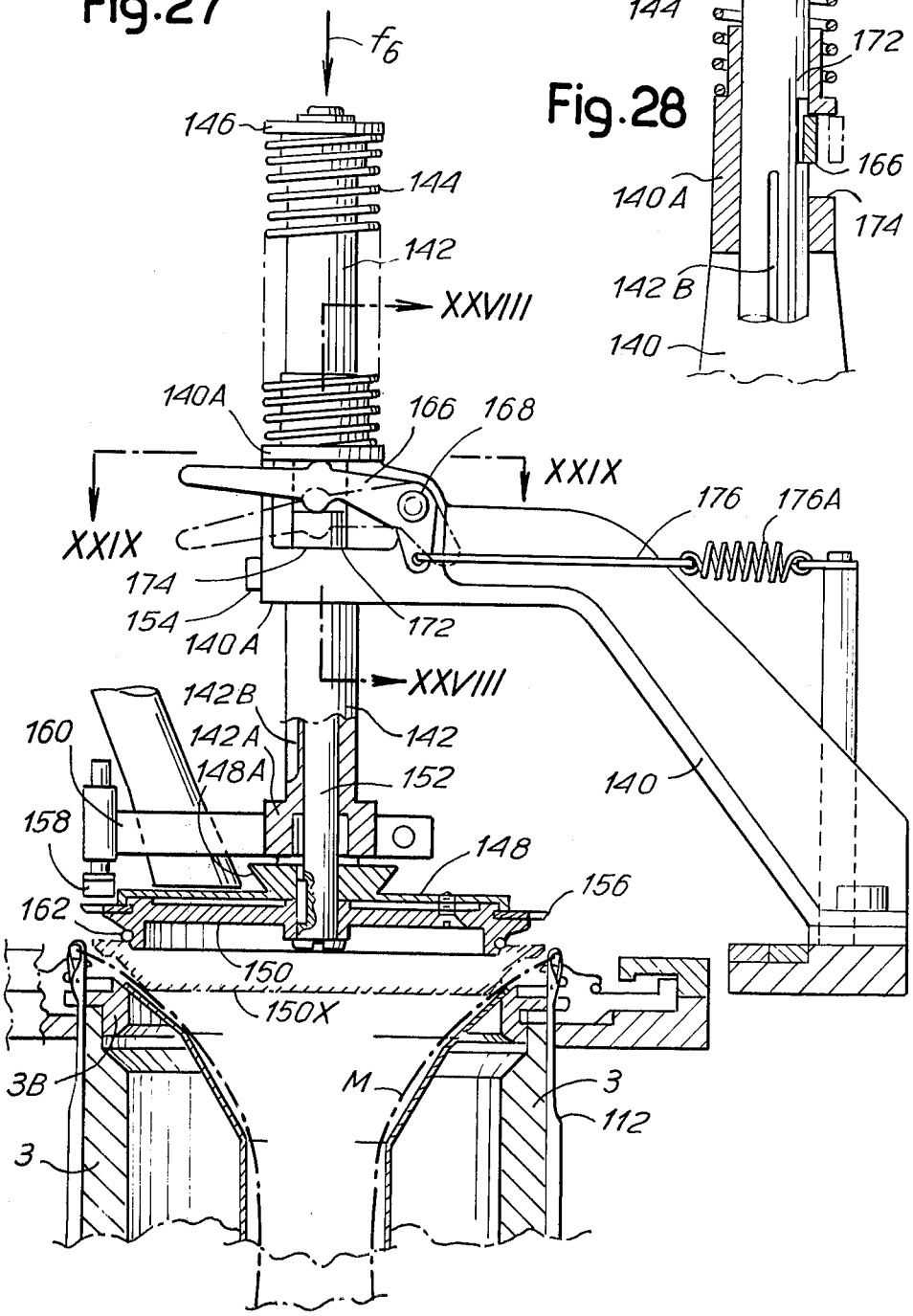
FIG. 27 is an elevational view, partially in section, of the upper end of the needle cylinder and associated elements and a yarn cutting mechanism mounted on the machine thereabove.

When the plate 150 is located in a position partly raised from the needle cylinder 3, as shown in FIG. 27 in full line, the disc 156 is stationary together with the unit 150, 152. When the plates 148 and 150 are lowered to a position indicated at 150X in FIG. 27 the annular friction element 162 engages the ring 3B of the needle cylinder 3 and is rotated thereby. In the lowered position 150X of the plate 150, the disc 156 reaches the active position for the cutting of the yarn together with one or the other of the knives 158, which have been lowered, together with the lower plate 150, with the column 142 in the hereinafter described manner. Thus, yarn is cut when, by action of the program, a lowering of the plate 150 is determined from the position shown in full lines in FIG. 27 to the position 150X indicated in dash lines in the figure.

In order to effect the movement of the column 142 from the raised position to the lowered position, a small lever 166 is provided on the head 140A of the arm. This lever 166 is pivoted on a pin 168, with respect to which the lever can be bent laterally outward as well as pivoted as clearly shown by the comparison between FIGS. 29 and 30. A small spring 170 tends to press the small lever 166 to the position shown in FIG. 29, that is towards and against the column 142. This column has a notch 172, which corresponds to a cut-out 174 of the head 140A and to the side of the lever 166, which is urged against the column 142 by the small spring 170. A tie-rod 176 with a spring 176A acts on the lever 166 and also the operator can act to separate the lever from the column 142 against the action of the spring 170.

Figure 28:
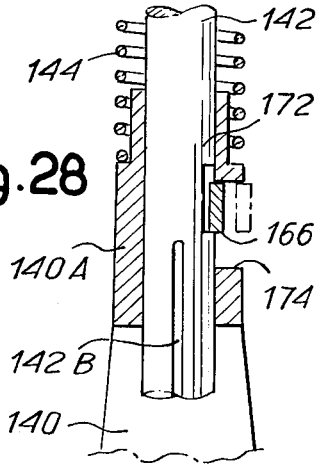
FIG. 28 is a vertical sectional view of a portion of FIG. 27 as viewed along line XXVIII—XXVIII of FIG. 27.
Figure 29:
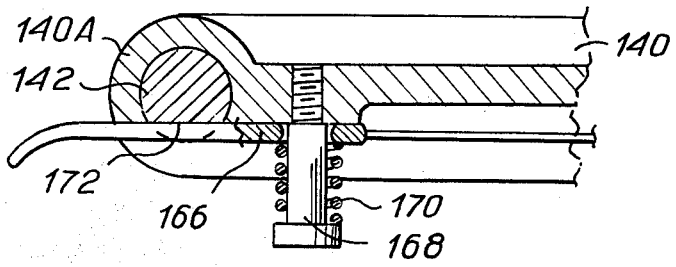
FIG. 29 is a vertical sectional view taken along line XXIX—XXIX of FIG. 27.

When the device is under the working conditions shown in FIGS. 27 to 29, the lever 166 is located in the notch 172 of the column 142, and in the raised position of the plate 150, as shown in FIG. 27, the spring 144 tends to raise the unit 142, 148 towards the top, against the counteraction of the lever 166 which is located between a side of the notch 172 and the upper edge of the cut-out 174. The device is thus ready for the operation of the yarn cutter by lowering of the plate 150 and rotation of the saw 156 by operation of the tie-rod 176, either directly by the program by means of an electromagnetic servomotor or the like, or by means of a cam of the drum 34 (which may be a cam combined to the yarn guide control system) in such a manner as to act on the lever 166 through the spring 166A to lower the column 142, overcoming the action of the spring 144. The elastic tension 176A causes the annular element 162 to contact by pressure the ring 3B of the needle cylinder, and thereby the plate 150 and then the disc 156 of the saw are rotated by the needle cylinder by frictional action, and the yarn cut effected with the temporary rotational actuation of the disc 156 in cooperation with the stationary knife blade 158. Upon ceasing by the returning of the tie-rod 176A, the same spring 144 returns the unit of the column 142 and of the plate 150 into the raised position shown in FIG. 31. The disc 150, accordingly, is rotated only when the yarn is being cut. The protecting piece 148A of the portion 148 is engaged by the yarn, which is thus tensioned by the action which is exerted thereon by the annular groove in the piece 148A.

Figure 30:
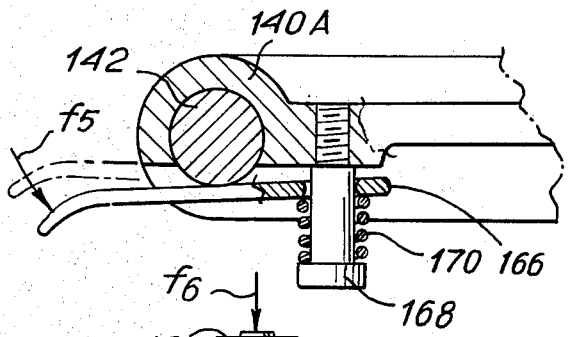
FIG. 30 is a view similar to FIG. 29 showing the elements in an alternate position.
Figure 31:
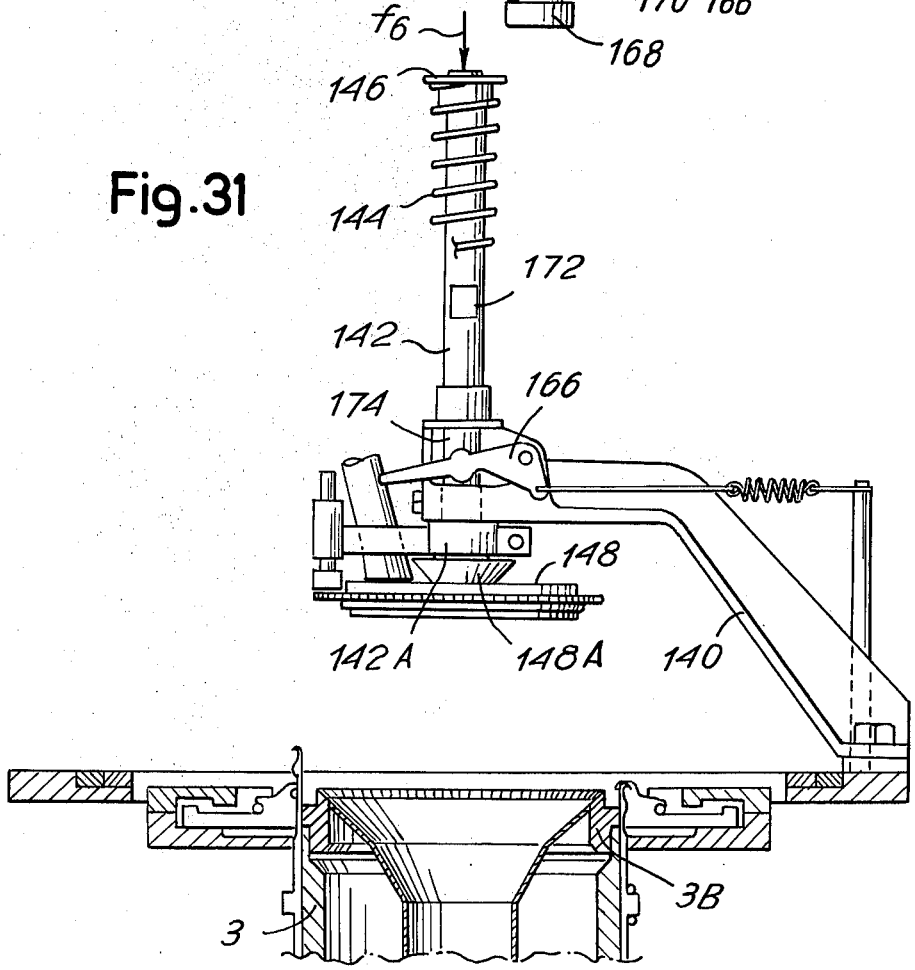
FIG. 31 is a view similar to FIG. 27 on a reduced scale showing the yarn cutting mechanism in a raised inoperative position.

When it is necessary to gain access to the upper section of the needle cylinder, that is when all the yarn guides and all the plates 108 are raised, or for any other requirements it must be possible to raise the plate 150 and the disc 148, it is necessary only to act on the lever 166 in the direction of the arrow f5 of FIG. 30 in such a manner as to separate the lever 166 against the action of the spring 170 from the notch 172 of the column 142. Under these conditions, the column 142 is no longer retained by the lever 166, and thus the spring 144 causes it to fully rise to the position in which the head 142A of the column 142 strikes against the head 140A of the arm 140. To lower the unit the head 146, is lowered in the direction of the arrow f6 of FIG. 31, to bring the notch 172 in correspondence with the lever 166, and trip the latter, through the spring 170, into the notch 172 to lock the device again in the arrangement for controlled movement between an inoperative position adjacent the needle cylinder (solid lines in FIG. 27) and an operative position (dash lines in FIG. 27) engaging the cylinder to effect yarn cutting.

It is intended that the drawing only shows an embodiment given just as a practical illustration of the invention, said invention being in condition as to be varied in the forms and arrangements without however, departing from the scope of the concept characterizing the same invention.

I claim:

1. In a circular knitting machine of the rotating cylinder type having a ring mounted at its upper end over which the fabric being knit passes into the cylinder, a yarn cutting device comprising a support, a disc having peripheral teeth thereon mounted for free rotation on said support coaxial with said cylinder and movable into frictional engagement with said cylinder for rotation of said disc with said cylinder, an annular resilient friction element seated in said device and facing said cylinder ring for engagement therewith to transmit rotation of the cylinder to rotation of said disc, stationary cutting means mounted on said support and cooperating with said rotating disc to cut yarn, and means for moving said disc into ring engagement for yarn cutting rotation therewith and away from said ring to an inoperative position.

2. In a circular knitting machine, the yarn cutting device according to claim 1 and characterized further in that said annular resilient friction element is seated in said device for engagement with said cylinder ring through the fabric being knit to transmit rotation of the cylinder to rotation of said disc.

3. In a circular knitting machine, the yarn cutting device according to claim 1 and characterized further by a column slidably mounted in said support, and a plate mounted for free rotation on said column and carrying said disc thereon, with said moving means sliding said column to move said disc between yarn cutting and inoperative positions.

4. In a circular knitting machine, the yarn cutting device according to claim 3 and characterized further in that said annular resilient friction element is seated in said plate for engagement with said cylinder ring through the fabric being knit when said disc is in yarn cutting position to transmit rotation of the cylinder to rotation of the disc.

5. In a circular knitting machine of the rotating cylinder type having a ring mounted at its upper end over which the fabric being knit passes into the cylinder, a yarn cutting device comprising a support, a disc having peripheral teeth thereon mounted for free rotation on said support coaxial with said cylinder and movable into frictional engagement with said cylinder for rotation of said disc with said cylinder, stationary cutting means mounted on said support and cooperating with said rotating disc to cut yarn, means for moving said disc into ring engagement for yarn cutting rotation therewith and away from said ring to an inoperative position, a column slidably mounted in said support, a plate mounted for free rotation on said column and carrying said disc thereon, with said moving means sliding said column to move said disc between yarn cutting and inoperative positions, an operating lever engageable in a notch in said column to retain said disc in either the yarn cutting or inoperative positions, with said moving means acting through said lever to move said column, said lever being disengagable from said notch to permit movement of said column away from said cylinder to permit access thereto.

6. In a circular knitting machine, the yarn cutting device according to claim 5 and characterized further by resilient means urging said column away from said cylinder to move said column away from said cylinder when said lever is disengaged from said notch and to urge said column to position said disc in its inoperative position when said lever is engaged in said notch, and said moving means acting through said lever and against the urging of said resilient means to move said disc to its yarn cutting position.

* * * * *

UNITED STATES PATENT OFFICE

CERTIFICATE OF CORRECTION

Patent No. 4,120,179 Dated October 17, 1978

Inventor(s) Fabrizio Micheletti

It is certified that error appears in the above-identified patent and that said Letters Patent are hereby corrected as shown below:

Column 4, line 5, delete "70" and insert therefor --40--.
Column 4, line 27, delete "58A" and insert therefor --68A--.
Column 4, line 51, delete "42" and insert therefor --74--.
Column 5, line 61, delete "74A" and insert therefor --64A--.
Column 6, line 53, delete "126." Column 7, line 43, delete "142" and insert therefor --152--. Column 8, line 42, delete "166A" and insert therefor --176A--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*